US007562714B2

(12) United States Patent
Lynde

(10) Patent No.: US 7,562,714 B2
(45) Date of Patent: Jul. 21, 2009

(54) CASING PATCH OVERSHOT

(75) Inventor: Gerald E. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/934,207

(22) Filed: Nov. 2, 2007

(65) Prior Publication Data

US 2008/0053656 A1 Mar. 6, 2008

Related U.S. Application Data

(62) Division of application No. 11/127,569, filed on May 12, 2005, now Pat. No. 7,422,068.

(51) Int. Cl.
*E21B 43/10* (2006.01)
*E21B 29/10* (2006.01)

(52) U.S. Cl. ..... 166/380; 166/384; 166/207

(58) Field of Classification Search ..... 166/207, 166/242.6, 380, 384, 277, 301; 405/259.3, 405/184.3; 72/370.06, 370.07, 370.08
See application file for complete search history.

(56) References Cited

U.S. PATENT DOCUMENTS

| | | | | |
|---|---|---|---|---|
| 2,789,005 | A * | 4/1957 | Foster | 294/86.26 |
| 3,005,655 | A * | 10/1961 | Jeffrey | 294/92 |
| 3,095,926 | A * | 7/1963 | Rush | 294/86.18 |
| 3,163,217 | A | 12/1964 | Haeber | |
| 3,191,677 | A | 6/1965 | Kinley | |
| 4,388,752 | A | 6/1983 | Vinciguera et al. | |
| 4,648,626 | A | 3/1987 | Vinciguerra et al. | |
| 4,817,716 | A | 4/1989 | Taylor et al. | |
| 4,827,748 | A | 5/1989 | Herring | |
| 5,095,991 | A | 3/1992 | Milberger | |
| 6,142,230 | A | 11/2000 | Smalley et al. | |
| 6,264,244 | B1 | 7/2001 | Isennock et al. | |

(Continued)

OTHER PUBLICATIONS

Gorrara, Andrew, et al., "Development of a Gas-Tight External Casing Patch Using Direct Hydraulic Expansion of Standard Casing to Achieve a Permanent Load Bearing Connection", SPE/IACD 92583, 2005, 1-9.
Agnew, J.W., "The Leaking Liner Top", SPE 12614, 1984, 7 pgs.
Lindvall, Jonas, et al., "Multilateral Tieback Insert Provides a Low-Cost, Sealing Multilateral Junction", SPE/IADC 57540, 1999, 1-9.
McCutcheon, J.B. Jr., et al., "Successful Salvage and Tie-Back Operations for a Hurricane-Damaged Satellite Well in the Gulf of Mexico", SPE 15450, 1986, 1-12.

*Primary Examiner*—Kenneth Thompson
(74) *Attorney, Agent, or Firm*—Steve Rosenblatt

(57) ABSTRACT

A connection to a stub downhole is accomplished in a variety of ways. A string has a tapered lower end inserted into the stub and expansion occurs from within the tapered lower end into the stub to leave a connection without reduction of the internal diameter. An overshot fitting can be lowered outside the stub and the stub expanded from within against the overshot. Both options in a single tool can be used to get sealing around the inside and the outside of the stub. An adjustable swage can be used with the overshot configuration where the overshot has an internal groove. The adjustable swage expands from within the stub into the surrounding groove in the overshot.

12 Claims, 4 Drawing Sheets

U.S. PATENT DOCUMENTS

| | | | | |
|---|---|---|---|---|
| 6,405,762 | B1 | 6/2002 | Bunch | |
| 6,561,271 | B2 | 5/2003 | Baugh et al. | |
| 6,585,053 | B2 | 7/2003 | Coon | |
| 6,907,652 | B1 * | 6/2005 | Heijnen | 29/447 |
| 6,997,264 | B2 | 2/2006 | Simpson et al. | |
| 7,195,073 | B2 | 3/2007 | Fraser, III | |
| 7,419,193 | B2 * | 9/2008 | Simpson | 285/382.4 |
| 2002/0195252 | A1 | 12/2002 | Maguire et al. | |
| 2004/0256112 | A1 | 12/2004 | Harrall et al. | |
| 2006/0113085 | A1 | 6/2006 | Costa et al. | |
| 2007/0110927 | A1 * | 5/2007 | Head et al. | 428/34.1 |

* cited by examiner

CASING PATCH OVERSHOT

PRIORITY INFORMATION

This application is a divisional application claiming priority from U.S. patent application Ser. No. 11/127,569, filed on May 12, 2005.

FIELD OF THE INVENTION

The field of this invention relates to patching casing downhole and more particularly tying into a casing stub to replace broken or damaged casing or tubulars above the cut.

BACKGROUND OF THE INVENTION

Frequently, when tubulars downhole degrade or are damaged a cut is made below the damaged portion. The upper portion of that string that could be hung off a larger tubular with a hanger is then removed from the well with the hanger. Tools are run in to remove the cement that was behind the removed tubular down to an area immediately surrounding the stub. Removal of the cement around the stub and dressing the exterior of the stub allows the replacement string of tubulars with an overshot fitting to be lowered down around the outside of the stub. Traditionally, these overshot fittings have included a soft metallic sealing material that was forced into specially made grooves in the inside diameter of the overshot fitting. The overshot would grab onto the casing stub and a pull would force the sealing material into the grooves and lock the two bodies together.

Other designs involved using an inflatable tool to expand the end of the stub into an overshot fitting with an interior configuration that included sealing material in grooves and a concave recess with serrations. Some examples of this design are U.S. Pat. Nos. 4,817,716 and 4,827,748. U.S. Pat. No. 4,648,626 also shows expansion using fluid pressure to urge a relatively softer metal into a surrounding tubular that has an irregular internal surface. A related design involves axially compressing a plug that is positioned within a stub until it deforms against a surrounding a flanged sleeve. This technique was used for repair for subsea pipelines. A related technique is described in U.S. Pat. No. 6,405,762 where pressure is used to expand the stub from within into a surrounding flanged sleeve with internal surface irregularities to promote grip. One issue with these techniques was control of the degree of expansion was difficult using the expansion techniques of applying hydraulic pressure or axially squeezing a plug to get it to move radially. Another issue is the unique application of some of these designs precludes their use downhole to connect to and seal against a casing stub, for example. Additionally these designs required sealing material to be displaced carefully into grooves and the connection to remain together with lock rings or due to surface irregularities and deformation of the stub into them from hydraulic expansion from within. Yet other techniques have been used to expand a patch into a tubular using a swage where the patch may have been fluted to reduce its diameter for insertion or the patch is simply expanded into contact with surrounding casing all at once or in stages. This type of art generally deals with inserting a patch in the middle of a casing string or hanging another string at the lower end of an existing string. Some examples of these approaches are U.S. Pat. Nos. 3,191,677; 6,142,230 and 6,561,271. Yet other designs for connecting tubulars require an initial flaring of the receiving tubular to accept another tubular that after insertion is deformed to put sealing bands into contact with the surrounding already flared tubular. This is illustrated in U.S. Pat. No. 5,095,991. In U.S. Pat. No. 6,585,053 a tubular string is inserted in a lager string and the top of the inner string is expanded pushing an exterior seal into the surrounding tubular. The tubular that was just inserted and expanded also presents a polished bore receptacle to receive yet another tubular string from the surface. U.S Application 2002/0195252 is similar.

What is needed and provided by the present invention is a technique and equipment that allows rapid connection to a stub downhole preferably using a swage and making a connection where the internal diameter is not reduced. Simple expansion techniques using a swage are employed to either expand the stub into an overshot connector. Another alternative technique inserts a tubular into the stub for tandem expansion and another variation involves insertion of a tubular end into the stub and an overshot component exterior to the stub to obtain and interior and exterior sealing on the stub. Optionally seals or surface irregularities can be employed to enhance sealing contact. These and other features of the present invention will be more readily apparent to those skilled in the art from a review of the description of the preferred embodiment, the drawings and the claims appended below.

SUMMARY OF THE INVENTION

A connection to a stub downhole is accomplished in a variety of ways. A string has a tapered lower end inserted into the stub and expansion occurs from within the tapered lower end into the stub to leave a connection without reduction of the internal diameter. An overshot fitting can be lowered outside the stub and the stub expanded from within against the overshot. Both options in a single tool can be used to get sealing around the inside and the outside of the stub. An adjustable swage can be used with the overshot configuration where the overshot has an internal groove. The adjustable swage expands from within the stub into the surrounding groove in the overshot.

DETAILED DESCRIPTION OF THE PREFERRED EMBODIMENT

Figure 1:
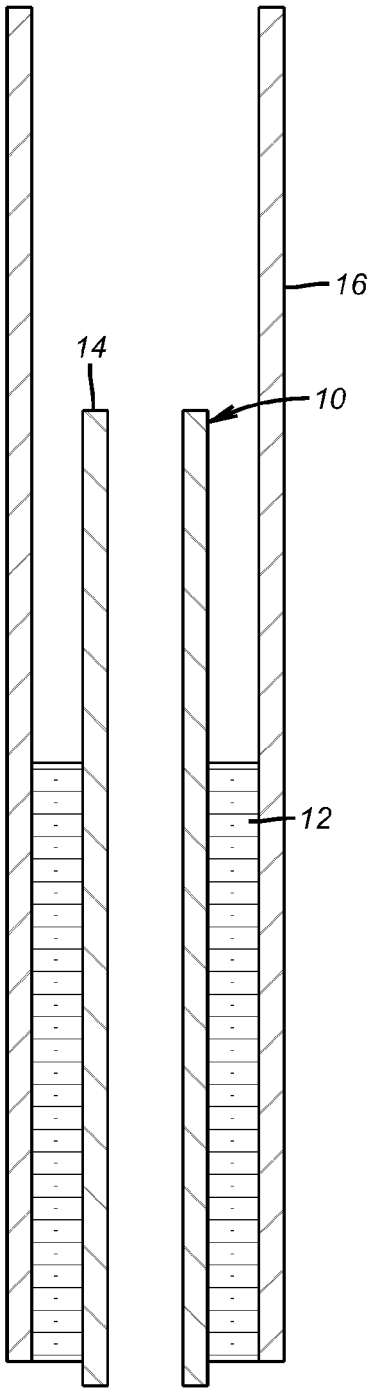
FIG. 1 shows the stub with cement cleaned out from around it ready for a connection.
Figure 2:
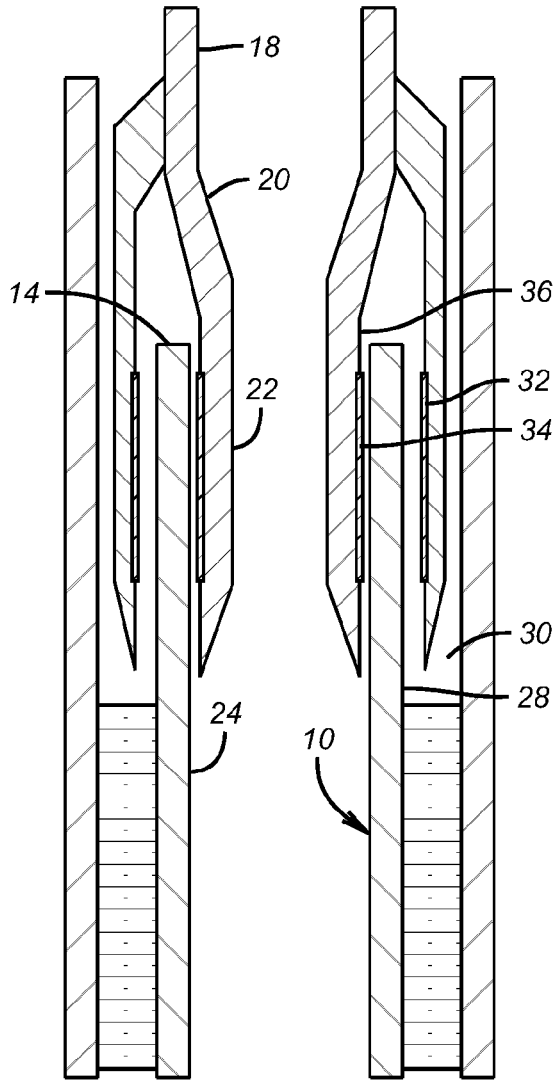
FIG. 2 shows the tool coming into the inside and over the outside of the stub prior to expansion.

FIG. 1 shows a stub 10 that has had the cement 12 removed from around its upper end 14 in wellbore 16. The procedure for removing a section of the casing or other tubular that produced the stub 10 is well known in the art and will not be described in any detail. In one embodiment of making a connection to the stub 10 a string 18 has a taper 20 leading to a lower end 22 that fits within inner wall 24 of the upper end 14 of stub 10. Connected just above the taper 20 is an overshot component 26 that initially goes over the outer wall 28 of the stub 10 and into the annular zone 30 where cement 12 has been removed. Outer surface 28 can be dressed to remove nicks and burrs by a tool known in the art that removes the cement 12. Optionally, the overshot 26 can have a sealing material and/or a surface irregularity 32 to enhance sealing against surface 28 when stub 10 is expanded from within lower end 22 of string 18 that is placed within inner wall 24. The sealing material 32 can be a resilient material like nitrile or a soft metal that is sprayed or otherwise applied copper or beryllium for example. The gripping surface can be a surface irregularity that is presented in a variety of patterns. Preferably the lower end 22 is about as thick as the upper end 14 of the stub 10. Optionally a seal and/or gripping material 34 can be used on outer surface 36 of lower end 22 to interact with surface 24 when expansion occurs. Material 34 can be identical to material 32 or they can be different or one or both of them can be optionally omitted.

Figure 3:
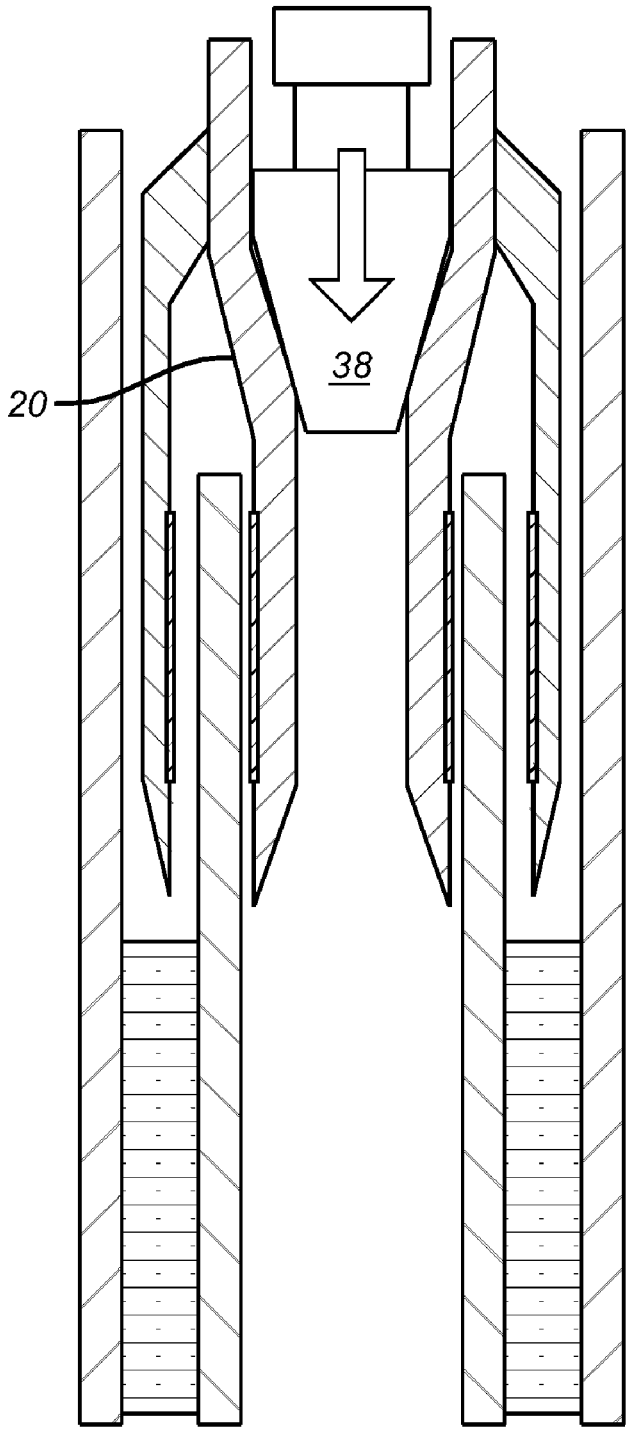
FIG. 3 shows the onset of swaging.
Figure 4:
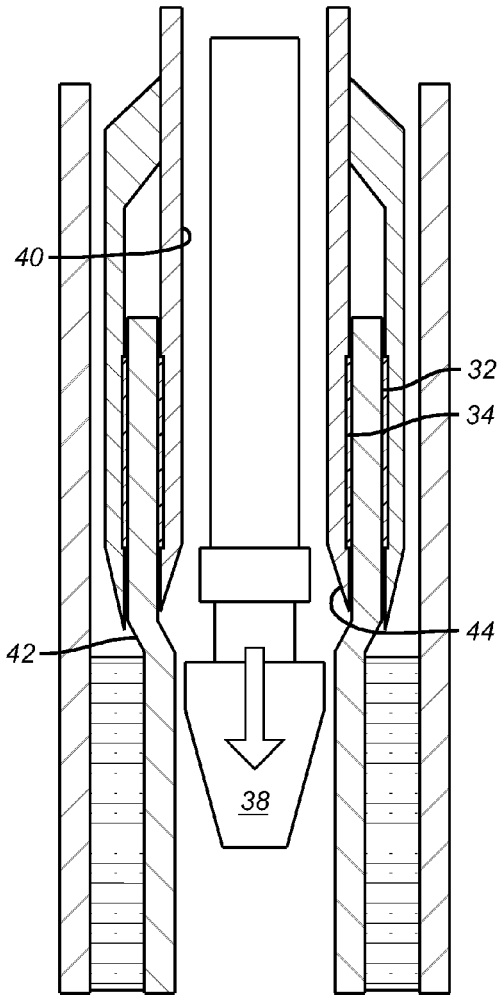
FIG. 4 shows the completion of swaging.
Figure 5:
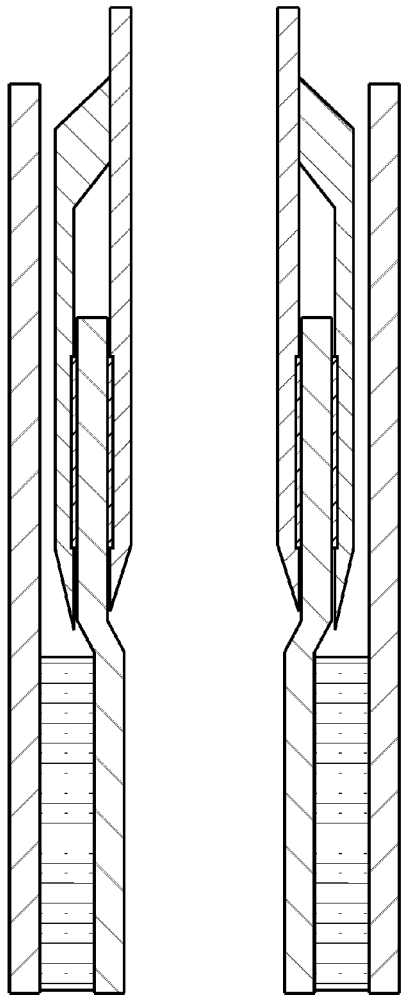
FIG. 5 shows the swage removed after expansion.

In FIG. 3, the swage 38 engages taper 20 on the way to expanding lower end 22 into the upper end 14 of the stub 10. FIG. 4 shows the swage 38 moved through the lower end 22 so that now its inner surface 40 presents an inside diameter at least as large as that at surface 24. A transition 42, created during expansion, makes that relation possible. The seal and or grip members, if used, are now also in contact respectively with overshot 26 and surface 36 of lower end 22. FIG. 5 is the same as FIG. 4 with the swage 38 removed. While a fixed swage is schematically illustrated, those skilled in the art will appreciate that all types of known expansion techniques could be employed in the present invention. Some examples are fixed and variable swages, roller expanders and techniques employing explosive force, to mention a few.

Those skilled in the art will appreciate that the connection to the stub 10 can be made using only the overshot portion 26 or just the tapered portion 20 with lower end 22 or both together as shown. The use of a seal coating or gripping surface treatment such as 32 or 34 is optional so that only one can be used or both or neither. The expansion can be by a fixed or adjustable swage 38 so as to allow the direction of expansion to be in the uphole or the downhole direction. The taper 44 at the lower end 22 can be optionally eliminated. It is preferred that after expansion there is no inside diameter deduction at upper end 14 and that the wall thickness of upper end 14 is close to that of the wall thickness of lower end 22, if used. The use of a fixed or adjustable swage allows better control of the total expansion because the outer limit of expansion is inherently controlled by the configuration of the swage offering an advantage over hydraulically powered expanders that can create more than the desired amount of expansion.

Figure 6:
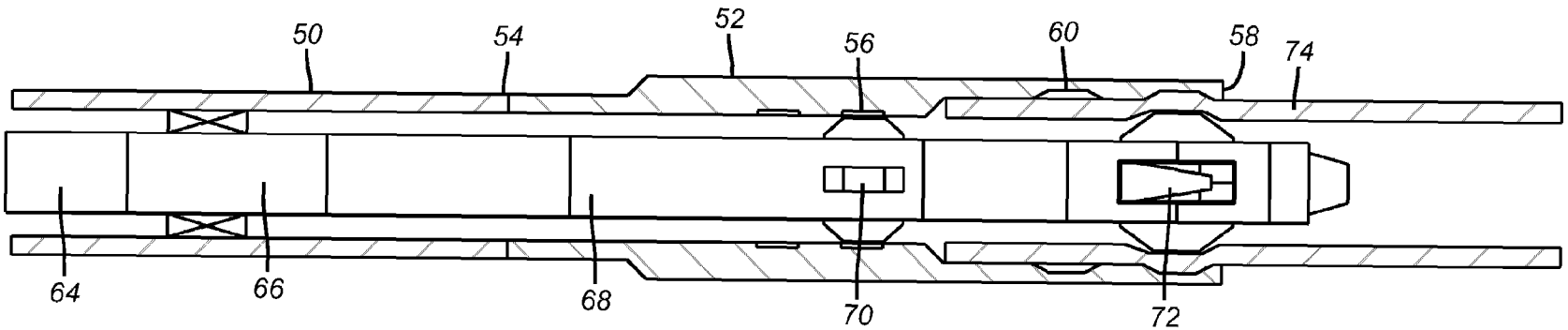
FIG. 6 shows an alternative embodiment of an overshot with internal grooves used in combination with an adjustable swage.

Referring now to FIG. 6, a casing string 50 has an overshot 52 connected to its lower end 54. Overshot 52 has one or more locator profiles 56 and, near a lower end 58 there are one or more surface irregularities 60 which preferably are recesses in inside surface 62 but can assume another configuration to enhance grip after expansion. A running string 64 supports an anchor 66 and a pulling tool 68. Locating dogs 70 engage profiles 56 to properly orient the adjustable swage 72 opposite an irregularity 60. When the swage 72 is in position, pressure is applied through string 64 to set the anchor 66 and actuate the pulling tool 68 to cause the adjustable swage 72 to increase its size radially and create an expansion force to drive the stub 74 outwardly in plastic deformation into sealing contact with irregularity 60. After that the pressure is removed from string 64 and the anchor 66 releases and the swage goes back to its minimum dimension for removal from string 50. Those skilled in the art will appreciate that the swage 72 can be translated as well as simply radially expanded. A fixed swage can also be used and expansion can occur in either an uphole or downhole direction. The irregularities 60 can be projections or depressions or combinations of both or neither can be used and simple expansion with swage 72 onto a cylindrical surface 62 can be used.

While the preferred embodiment has been set forth above, those skilled in art will appreciate that the scope of the invention is significantly broader and as outlined in the claims which appear below.

I claim:

1. A method of connecting a string to a tubular stub in a wellbore, comprising: providing an overshot component on said string to go over said stub;

expanding said stub with a mechanical swage that is one of a fixed or variable dimension;

providing an indexing mechanism in said overshot to aid in positioning said swage within said overshot and said stub;

performing said expanding by increasing the diameter of said swage without axially translating it.

2. A method of connecting a string to a tubular stub in a wellbore, comprising:

providing an overshot component on said string to go over said stub;

expanding said stub with a mechanical swage that is one of a fixed or variable dimension; and providing an indexing mechanism in said overshot to aid in multiple positioning of said swage within said overshot component that is placed over said stub.

3. The method of claim 2, comprising:

performing said expansion by translating said swage axially.

4. The method of claim 2, comprising:

providing at least one of a grip and a seal enhancing treatment on at least one of the stub and overshot component surfaces that come together from said expanding.

5. The method of claim 4, comprising:

providing a recess as said one of a grip and seal enhancing treatment.

6. A method of connecting a string to a tubular stub in a wellbore, comprising: providing an overshot component on said string to go over said stub; expanding said stub with a mechanical swage that is one of a fixed or variable dimension; and providing an indexing mechanism in said overshot to aid in positioning said swage within said overshot and said stub;

providing at least one of a grip and a seal enhancing treatment on at least one of the stub and overshot component surfaces that come together from said expanding;

providing a recess as said one of a grip and seal enhancing treatment;

locating said variable dimension swage in said overshot component by an indexing feature in said overshot component;

setting an anchor in said string;

actuating a tool to increase the diameter of said swage;

deforming a portion of said stub into said recess.

7. A method of connecting a string to a tubular stub in a wellbore, comprising:

providing an overshot component on said string to go over said stub;

expanding said stub with a mechanical swage that is one of a fixed or variable dimension; and producing through said stub and string after said expanding.

8. The method of claim 7, comprising:

providing at least one of a grip and a seal enhancing treatment on at least one of the stub and overshot component surfaces that come together from said expanding.

9. The method of claim 8, comprising:

providing a recess as said one of a grip and seal enhancing treatment.

10. The method of claim 7, comprising:

providing an internal taper in said string adjacent said overshot component.

11. The method of claim 10, comprising:

supporting a swage on said taper.

12. The method of claim 11, comprising:

extending a lower end of said string below said taper into said stub.

* * * * *